US005403407A

United States Patent [19]

Hadjipanayis et al.

[11] Patent Number: 5,403,407

[45] Date of Patent: Apr. 4, 1995

[54] PERMANENT MAGNETS MADE FROM IRON ALLOYS

[75] Inventors: G. C. Hadjipanayis; Wei Gong, both of Newark, Del.

[73] Assignee: University of Delaware, Newark, Del.

[21] Appl. No.: 44,413

[22] Filed: Apr. 8, 1993

[51] Int. Cl.[6] ..... H01F 1/053

[52] U.S. Cl. ..... 148/301; 420/83

[58] Field of Search ..... 148/301, 302, 303; 420/83, 121

[56] References Cited

U.S. PATENT DOCUMENTS

| | | | |
|---|---|---|---|
| 5,114,502 | 5/1992 | Bogatin | 148/302 |
| 5,135,584 | 8/1992 | Fujiwara | 148/301 |
| 5,186,766 | 2/1993 | Iriyama et al. | 148/301 |

FOREIGN PATENT DOCUMENTS

| | | | |
|---|---|---|---|
| 453270 | 10/1991 | European Pat. Off. | 148/301 |
| 60-144906 | 7/1985 | Japan | 148/302 |
| 1-261801 | 10/1989 | Japan | 420/83 |
| 4-241402 | 8/1992 | Japan | 148/301 |

OTHER PUBLICATIONS

J. Appl. Phys., vol. 61 (8), "Formation and Properties of NdFeB Prepared by Mechanical Alloying and Solid State Reaction", Schultz et al., Apr. 15, 1987, pp. 3583-3585.

J. Appl. Phys., vol. 70 (10), "Permanent Magnets by Mechanical Alloying (Invited)", Schultz et al., Nov. 15, 1991, pp. 6339-6344.

*Primary Examiner*—George Wyszomierski

*Attorney, Agent, or Firm*—Connolly and Hutz

[57] ABSTRACT

A new alloy for permanent magnets which is of the composition $(R_xFe_{y-w}Co_wM_z)L_\alpha$ transition metals M such as, but not limited to Cr, Mo, Ti and V and mixtures thereof. R would be rare earth metals such as, but not limited to Nd, Pr, Dy and Tb, other rare earths, Y, and La and mixtures thereof. L is carbon or nitrogen or a mixture thereof. x+y+z equals 100 atomic %, x is from about 5 to about 20%, y is from about 65 to about 85%, z is from about 6 to about 20%, $w \leqq 20\%$, and $\alpha$ is from about 4 to about 15%. We have also developed a new process whereby the alloy metal magnets are formed by taking the ingredients and arc melting the individual elements R, Fe, Co and M at least once whereby forming an alloy ingot, and if necessary, remelting the alloy ingot as many times as necessary and reforming the alloy to form a more uniform alloy. The alloy formed is then ground into a powder. The powders are then formed into magnets and are bonded at high temperatures.

19 Claims, 4 Drawing Sheets

PERMANENT MAGNETS MADE FROM IRON ALLOYS

BACKGROUND OF THE INVENTION

It has been known in the art of permanent magnets to use mechanical alloying and apply it to prepare $Nd_2Fe_{14}B_1$ (2:14:1 Phase), $Sm(Fe—TM)_{12}$ (1:12 Phase) and interstitial nitrided and carbided permanent magnets wherein the transition metal (TM) is V, Ti and Zr. However, if $Nd_2Fe_{17}$ (2:17) phase or $Sm(FeTM)_{12}$ is nitrogenated or carbonated the coercivity becomes very low. The prior art started from elemental powders, the hard magnetic phases are formed by milling followed by solid state reaction at relatively low temperatures. In Nd—Fe—B, the magnetic isotrope particles are microcrystalline, show a high coercivity (up to 16 kA/cm for ternary alloys and above for Dy-substituted samples) (J. Appl. Phys. No. 70 (10), Nov. 15 1991, pp. 6339–6344). In the prior art the previous 1:12 alloys were based on Sm-containing compounds. Sm, however, is an expensive rare earth metal as compared to Nd and Pr. We have discovered a new permanent magnet based on the 1:12 phase that does not require the use of the expensive Sm rare earth metal.

SUMMARY OF THE INVENTION

It is an object of this invention to fabricate a permanent magnet having very high coercivities while maintaining a high magnetic moment and Curie temperature $T_c$. It is a further object of this invention to develop a process to manufacture a magnet having high coercivities while maintaining a high magnetic moment and high $T_c$. We have discovered a new alloy for permanent magnets which is of the composition $(R_xFe_{(y-w)}Co_wM_z)L_\alpha$ wherein x+y+z equals 100 in atomic percent; w is from zero to about 20%; x is from about 5 to about 20%; y is from about 65 to about 85% and z is from about 6 to about 20%. M would be transition metals, preferably W, Mn, Cr, Mo, Ti and V and mixtures thereof. R would be rare earth metals, preferably Nd, Pr, Dy, Tb and Mm (mish-metal rare earth) and mixtures thereof. L would be carbon or nitrogen or mixture thereof. $\alpha$ would be from about 4 to about 15 %. We have also developed a new process whereby the alloy metal magnets are formed by taking the ingredients and are melting the individual elements R, Fe, Co and M at least once whereby forming an alloy ingot, and if necessary, remelting the alloy ingot as many times as necessary and reforming the alloy to form a more uniform alloy. The alloy formed is then ground into a powder. The powders are then formed into magnets and are bonded at high temperatures.

DETAILED DESCRIPTION OF THE INVENTION

Figure 1:
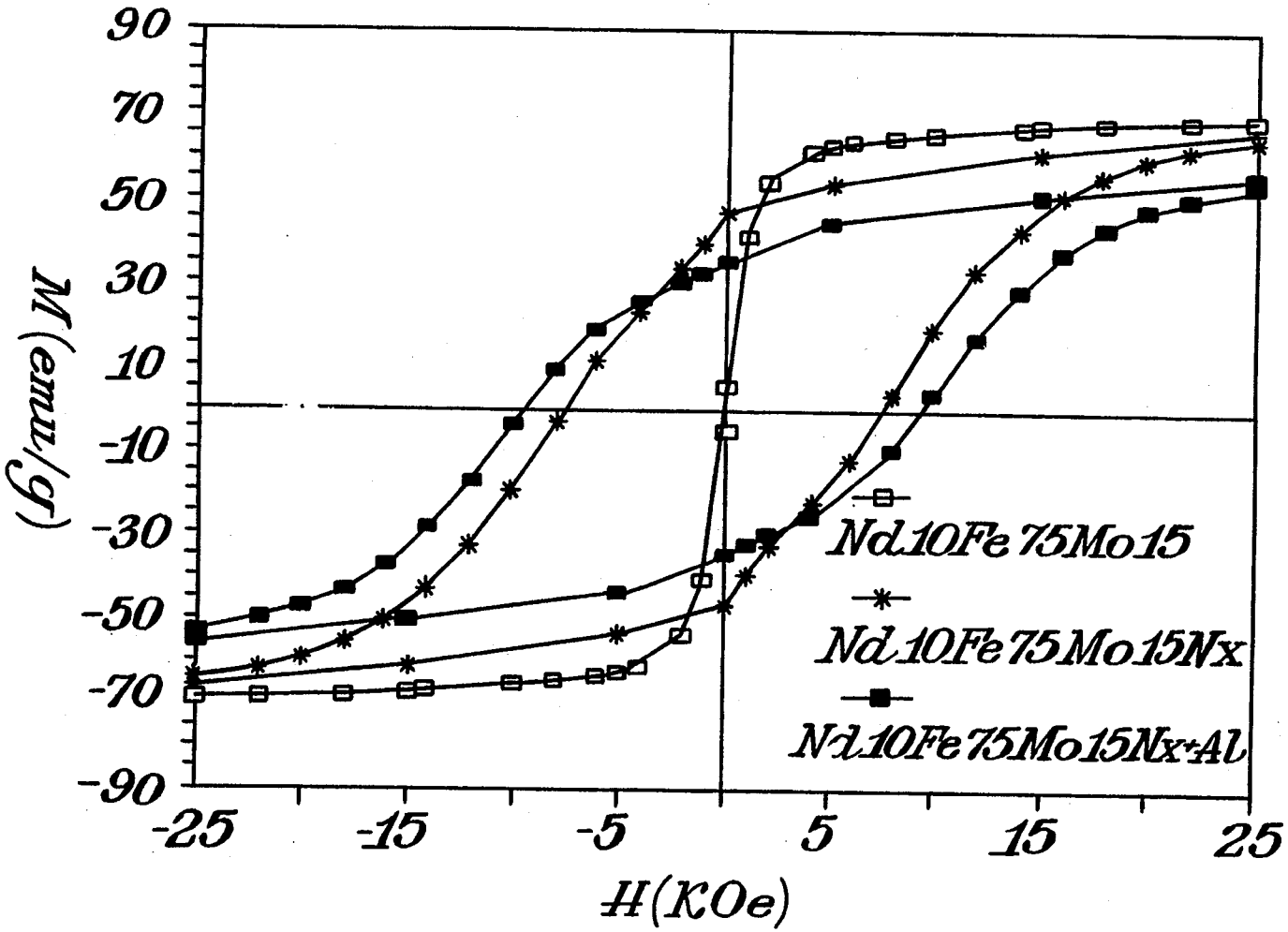
FIG. 1 shows three hysteresis loops of $Nd_{10}Fe_{75}Mo_{15}$, $Nd_{10}Fe_{75}Mo_{15}N_x$ and $Nd_{10}Fe_{75}Mo_{15}N_x$+Al.

The object of this invention is to make permanent magnets from $(R_xFe_{(y-w)}Co_wM_z)L_\alpha$ wherein M would be transition metals preferably W, Mn, Cr, Mo, Ti and V and mixtures thereof and R would be rare earth metals preferably Nd, Pr, Mm, Dy and Tb and mixtures thereof, in particular at least Nd or Pr or mixture thereof and optionally Mm, Dy and Tb. L is carbon or nitrogen or a mixture thereof. x+y+z being equivalent to 100 atomic %, "w" is from zero to about 20, preferably up to about 10%; "x" is from about 5 to about 20%, preferably about 8 to about 15%, and more preferably 10 to about 12%; "y" is from about 65 to about 85 %, preferably about 70 to about 80% and more preferably about 75 to about 80%; "z" is from about 6 to about 20%, preferably about 10 to about 20% and more preferably about 10 to about 16%, and "$\alpha$" is from about 4 to about 15%. Generally Dy and Tb or mixtures of Dy and Tb would be in an amount up to about 10% at most.

Additions of cobalt, up to about 20% leads to further increase of the Curie temperature ($T_c$). The iron and cobalt gives most of the magnetic induction. The R provides the anisotropy. The M elements help to form a particular R—Fe—M phase, the 1:12 phase having a high magnetic moment and high $T_c$.

The permanent magnets are made by the following process. First the elemental R, Fe and M are made into an alloy ingot by are melting in an inert gas, preferably argon. The are melting forms an alloy ingot. The alloy ingot can then be are melted in an inert gas several more times in order to form a more homogenous alloy. It should be are melted at least one time and preferably are melted three or four times. The are melting temperature must be greater than the highest melting point of all the elements.

The R—Fe—M alloys are milled in a high energy ball miller under inert gas, preferably using argon atmospheres resulting in a microstructure which is a mixture of a non-equilibrium phase with some amorphous phase. The high energy ball billing leads to a nano crystalline structure which is a mixture of $\alpha$-Fe with some amorphous phase. The ball-milled powders are heat treated in the temperature range of about 500° to about 1000° C. and preferably about 700° to 850° C. for about 15 minutes to about 60 minutes where a nano-crystalline 1:12 structure is formed. The hard magnetic properties of the R—Fe—M powders are obtained after nitrogenation or carbonation at temperatures in the range from about 400° to about 700° C. for about 1 to about 4 hours using about a 50 kPa pressure of nitrogen or methane ($CH_4$). The $R—(FeM)_{12}$ compounds are drastically changed after nitrogenation resulting in increases in the Curie temperature $T_c$ saturation magnetization $M_s$ and anisotropy constant K, which make these compounds candidates for permanent magnet. The R—Fe—M magnets were metal bonded at temperatures from about 400° to about 700° C. preferably about 400° to about 600° C. using fine powders of low melting point materials such as, but not limited to, zinc or aluminum with a size of about 20 $\mu$m.

The advantage of our process is that the magnets are made from alloy powders and not from elemental powders as is usually the case. The rare earth elements are very expensive. This process protects the rare earth elements from oxidation. Therefore, less rare earth elements are needed. Usually, in the prior art, the rare earth powders are easily oxidized in the fine particle form and that is one of the advantages to using an alloy powder mix to prevent this oxidation. In addition, a small excess of R in the R—Fe—M system leads to a high coercivity in the nitrogenated powder which has a single phase ($ThMn_{12}$-type). Another advantage is the R—Fe—Mo—$N_x$ is quite stable at high temperatures (about 650° C.). The R—Fe—Mo—$N_x$ can be bonded with aluminum powders at high temperatures. The R—Fe—Mo—$N_x$ and R—Fe—Cr—$N_x$ magnets are a new kind of permanent magnets which have a high magnetization, anisotropy, and a high Curie temperature and, therefore a great potential for permanent magnet development.

$Nd_2Fe_{14}B_1$ has a $T_c$ of about 310° C. while we have been able to achieve a much higher Tc according to the invention.

Listed below are some of the examples of magnetic properties of Nd—Fe—Cr nitrides (Tables 1–5).

Experimental Results of Nd—Fe—Cr Nitrides are as follows:

The coercivities of the $Nd_{10}Fe_{75}Cr_{15}N_x$ compounds were found to depend on the preparation conditions especially on the crystallization temperature $T_{Cry}$ and nitrogenation temperature $T_N$ as summarized in Table 4. The highest coercivity obtained was 4.5 kOe at $T_{cry}$ equivalent to 800° C. for 30 minutes and $T_N$ equivalent to 580° C. for 2 hours. The magnetization $M_s$ at 55 kOe of the compounds was 105 and 101 emu/g at 273K and 10K, respectively. The magnetization $M_s$ was lower at 10K because the maximum magnetic fields was not high enough to saturate the magnetization. The x-ray diffraction peaks of the nitrogenated sample were shifted to lower angles. The interstitial nitrogen atoms lead to an increase of saturation magnetization, Curie temperature and magnetic anisotropy.

When the chromium content is reduced from 15 to 12 at %, the coercivities of $Nd_{10}Fe_{78}Cr_{12}N_x$ compounds were decreased (Table 5). The highest $H_c$=3.4 kOe was obtained in sample prepared at $T_{cry}$ being equivalent to 800° C. for 30 minutes and $T_N$ being equivalent to 520° C. for 2 hours. The magnetization curves of the $Nd_{10}Fe_{78}Cr_{12}N_x$ sample have $M_s$ equivalent to 127 emu/g and $H_c$ equivalent to 3.0 kOe at 273K and $M_s$ equivalent to 130 emu/g and Hc=12 kOe at 10K. Compared to the $Nd_{10}Fe_{75}Cr_{15}N_x$ compound, the decrease in coercivity was about $\Delta$Hc=1.5 kOe.

When the neodymium content increased from 10 to 12 at %, the coercivities of $Nd_{12}Fe_{73}Cr_{15}N_x$ compounds increased in as shown in Table 1. The best coercivity $H_c$ was equivalent to 6.5 kOe was obtained after $T_{Cry}$ at 700° C. for 30 minutes and $T_N$ at 520° C. for 2 hours (see Table 2). The increase in coercivity was about $\Delta H_c$ equivalent to 2.0 kOe when the Nd content increased by 2 at % in the $Nd_{12}Fe_{73}Cr_{15}N_x$ compounds.

$Nd_{12}Fe_{73}Cr_{15}N_x$ nitrides were bonded at temperatures in the range of 480°–520° C. for 1 hours using AgCl and CuBr powders. Unfortunately, the coercivities of the bonded magnets were reduced quickly to 0.5 kOe when the bonding temperature increased to 520° C. (see Table IV). It may be AgCl and CuBr powders have a chemical reaction with the 1:12 phase and destroy the hard magnetic phase. An increased α-Fe precipitation (out of the 1:12 phase) was observed in the bonded samples by x-ray diffraction.

TABLE 1

Magnetic Properties of Nd—fe—Cr Nitrides

| | Ms (emu/g) | Hc (kOe) | Tc (°C.) |
|---|---|---|---|
| $Nd_{10}Fe_{78}Cr_{12}N_x$ | 133 | 3.0 | 478 |
| $Nd_{10}Fe_{75}Cr_{15}N_x$ | 112 | 4.5 | 480 |
| $Nd_{12}Fe_{73}Cr_{15}N_x$ | 105 | 6.5 | 460 |

Ms = Saturation magnetization
Hc = Coercivity
Tc = Curie temperature

TABLE 2

Magnetic properties of $Nd_{12}Fe_{73}Cr_{15}$ nitrides after different crystalization temperatures $T_{cry}$ and nitrogenation temperatures $T_N$.

| $T_{cry}$ (°C.) | $T_N$ (°C.) | $H_c$ (kOe) |
|---|---|---|
| 650 | 520 | 6.3 |
| 700 | 520 | 6.5 |
| 750 | 520 | 5.5 |
| 650 | 550 | 5.1 |
| 700 | 550 | 6.3 |
| 750 | 550 | 5.2 |
| 800 | 550 | 4.1 |
| 850 | 550 | 4.3 |
| 700 | 580 | 4.4 |
| 750 | 580 | 4.3 |
| 800 | 580 | 4.2 |
| 850 | 580 | 4.6 |
| 700 | 610 | 2.2 |
| 750 | 610 | 2.2 |
| 800 | 610 | 2.6 |
| 850 | 610 | 3.0 |

TABLE 3

$Nd_{12}Fe_{73}Cr_{15}$ nitrides bonded by CuBr and AgCl powders at different temperatures $T_{bond}$

| $T_{bond}$ (°C.) | $H_c$ (kOe) CuBr | $H_c$ (kOe) AgCl |
|---|---|---|
| 480 | 2.0 | 3.0 |
| 500 | 1.0 | 3.0 |
| 520 | 0.3 | 0.5 |

TABLE 4

Coercivities of $Nd_{10}Fe_{75}Cr_{15}N_x$ at different preparation conditions.

| $T_{cry}$ (°C./30 min) | $T_N$ (°C./2 hr) | $H_c$ (kOe) |
|---|---|---|
| 850 | 0 | 0.2 |
| 800 | 530 | 1.1 |
| 850 | 530 | 1.2 |
| 900 | 530 | 1.6 |
| 800 | 580 | 4.5 |
| 850 | 580 | 3.5 |
| 900 | 580 | 3.2 |
| 750 | 590 | 1.5 |
| 800 | 590 | 3.9 |
| 850 | 590 | 3.6 |
| 900 | 590 | 2.8 |
| 750 | 620 | 0.5 |
| 800 | 620 | 1.6 |
| 850 | 620 | 2.5 |
| 900 | 620 | 2.4 |

TABLE 5

Coercivities of $Nd_{10}Fe_{78}CrN_x$ at different preparation conditions.

| $T_{cry}$ (°C./30 min) | $T_N$ (°C./2 hr) | $H_c$ (kOe) |
|---|---|---|
| 800 | 520 | 3.4 |
| 850 | 520 | 3.2 |
| 900 | 520 | 2.1 |

The advantages of Nd—Fe—M (M=Ti, V, Mo) are described in an article we wrote, which was published September, 1992 in IEEE Transactions on Magnetics, Vol. 28, No. 5, which is incorporated by reference, entitled "Nitrogenated 1:12 Compounds by Mechanical Alloying".

Detailed lattice parameters are summarized in Table 6, for $Nd_{10}Fe_{90-y}M_y$ (M=Ti, y=8), Mo and V; y=8, 15). The change in unit cell volume upon nitrogenation was $\Delta V/V=5.5$, 3.0 and 3.6% for M=Ti, Mo and V. It is found that $\Delta V/V$ of mechanically alloyed powders is larger than that of as-cast alloy powders. It appears that nitrogen enters the $ThMn_{12}$ structure more easily in powders with smaller grains at lower nitrogenation temperatures.

The interstitial nitrogen atoms lead to an increase of saturation magnetization $M_s$, Curie temperature $T_c$ and anisotropy constant K. The magnetic properties of all samples were summarized in Table 7. The saturation magnetization was found using the law of approach to saturation by plotting M as a function of $1/H^2$ and extrapolating to infinite fields. The changes in Curie temperature upon nitrogenation were almost the same, about 30%, for the three compounds listed in Table 7. The increase of Curie temperature is caused by an enhancement of Fe—Fe exchange interactions due to the increase in lattice parameters. The coercivity $H_c$ is increased from 0.5 to 7.5 kOe after nitrogenation.

TABLE 6

Lattic parameters of mechanical alloyed Nd $(FeM)_{12}$ upon nitrogenation.

| | a (Å) | c (Å) | V (Å$^3$) | ΔV/V % |
|---|---|---|---|---|
| $Nd_{10}Fe_{82}Ti_8$ | 8.598 | 4.779 | 353.29 | |
| $Nd_{10}Fe_{82}Ti_8N_x$ | 8.756 | 4.861 | 372.67 | 5.5 |
| $Nd_{10}Fe_{75}Mo_{15}$ | 8.612 | 4.823 | 357.75 | |
| $Nd_{10}Fe_{75}Mo_{15}N_x$ | 8.692 | 4.876 | 368.39 | 3.0 |
| $Nd_{10}Fe_{75}V_{15}$ | 8.562 | 4.775 | 350.04 | |
| $Nd_{10}Fe_{75}V_{15}N_x$ | 8.646 | 4.851 | 362.64 | 3.6 |

TABLE 7

Magnetic properties of mechanically alloyed Nd $(FeM)_{12}$ powders upon nitrogenation.

| | Tc (K) | ΔTc/Tc (%) | $Ms_{(10K)}$ (emu/g) | $Hc_{(10K)}$ (kOe) | $Ms_{(295K)}$ (emu/g) | $Hc_{(295K)}$ (kOe) |
|---|---|---|---|---|---|---|
| $Nd_{10}Fe_{82}Ti_8$ | 551 | | 129.8 | 4.5 | 113.2 | 0.5 |
| $Nd_{10}Fe_{82}Ti_8N_x$ | 716 | 30 | 140.4 | 7.0 | 132.6 | 2.5 |
| $Nd_{10}Fe_{75}Mo_{15}$ | 450 | | 106.6 | 3.0 | 72.8 | 0.5 |
| $Nd_{10}Fe_{75}Mo_{15}N_x$ | 578 | 30 | 91.5 | 28.0 | 85.0 | 8.0 |
| $Nd_{10}Fe_{75}V_{15}$ | 583 | | 103.2 | 1.5 | 91.4 | 0.5 |
| $Nd_{10}Fe_{75}V_{15}N_x$ | 768 | 32 | 119.5 | 30.0 | 131.0 | 7.5 |

The advantages of mechanically allowed 1:12 nitrides and carbides is described in an article entitled "Mechanically Alloyed 1:12 Nitrides and Carbides" which has been submitted by us to the publisher and will be published in the Journal of Applied Physics, Volume 73(10), May 15, 1993 and is enclosed and incorporated by reference.

X-ray diffraction measurements confirmed that the $Nd_{10}Fe_{82}Mo_8$ compound is still a single 1.12 phase with a tetrgonal structure like the $Nd_{10}Fe_{75}Mo_{15}$ compound. It is obvious that with decreasing Mo content, $M_s$ and $T_c$ increase. The increases were about $\Delta M_s=24$ emu/g and $\Delta T_c$ being equal to 45° C. for Mo content being from 15 to 8%. However, the coercivity was reduced from 8 to 4.6 kOe. Also the lower Mo content samples were not stable at higher nitrogenation temperatures. α-Fe appears to precipitate out at 610° C. when Mo is at about 8 at. % as compared to 860° C. for the Mo sample at 15%. The experimental data are summarized on Table 8.

A careful experiment with weight analysis for $Nd_{10}Fe_{75}Mo_{15}N_x$ nitrides showed that higher value of $H_c$, $M_s$ and $T_c$ were related to the higher nitrogen content obtained at the higher nitrogenation temperatures. All the experimental data are summarized in Table 9. The weight increase in weight percent of the sample upon nitrogenation is given by $\Delta W=(W_N-W)/W$, where W and $W_N$ are the weights of the sample before and after nitrogenation. A maximum N content with x being equal to 10% in the $Nd_{10}Fe_{75}Mo_{15}N_x$ sample was obtained after nitrogenation at 650° C. for 2 hours resulting in the best hard magnetic properties $H_c=8.0$ kOe, $M_x=84.5$ emu/g and $T_c=310$° C. The x value of N content in the mechanically alloyed samples is much higher than the reported value in as-cast alloys, x=0.5 at. % in $NdFe_{10}Mo_2N_x$. When the nitrogenation temperature is higher than 700° C., the weight analysis still shows an increase in the x value but the coercivity of the sample is lower because α-Fe is precipitated out of the 1:12 phase.

TABLE 8

Magnetic properties of $Nd_{10}Fe_{(90-y)}Mo_yN_x$ samples

| Y (at %) | Ms (emu/g) | $Hc_{(R.T.)}$ (kOe) | $Hc_{(10K)}$ (kOe) | Tc (°C.) |
|---|---|---|---|---|
| 8 | 108.5 | 4.0 | 19 | 355 |
| 12 | 99.0 | 6.0 | 21 | 335 |
| 15 | 84.5 | 8.0 | 29 | 310 |

TABLE 9

Room temperature magnetic properties $M_s$, $H_c$ and $T_c$ of $Nd_{10}Fe_{75}Mo_{15}N_x$ ($N_x$, x = 5–15) compound as a function of nitrogen content x at different nitrogenation temperatures.

| $T_N$ (°C./2 hr) | ΔW (wt %) | x (at %) | $M_s$ (emu/g) | $H_c$ (kOe) | $T_c$ (°C.) |
|---|---|---|---|---|---|
| 0 | 0 | 0 | 73.5 | 0.5 | 177 |
| 550 | 1.44 | 7 | 79.5 | 3.5 | 230 |
| 600 | 1.74 | 8 | 82.0 | 5.2 | 260 |
| 650 | 2.02 | 10 | 84.5 | 8.0 | 310 |
| 700 | 2.59 | 13 | 76.5 | 4.0 | 310, 770 |

Listed below are only some of the examples of Nd—Fe—Mo—Nx samples on different prepared conditions (crystallization temperature $T_{cry}$ and nitrogenation temperature $T_{nitro}$) in Tables 10–12.

TABLE 10

Dependence of Coercivity on the Bonding Temperature in Nitrogenated $Nd_{10}Fe_{78}Mo_{12}$ (with VSM):

| $T_{cry}$ (°C.) | $T_{nitro}$ (°C.) | Hc (kOe) |
|---|---|---|
| 800 | 630 | 5.8 |
| 850 | 630 | 5.8 |
| 900 | 630 | 5.5 |

TABLE 11

| Magnetic properties of Nitrogenated $Nd_{10}Fe_{82}Mo_8$ | | |
|---|---|---|
| $T_{cry}$ (°C.) | $T_{nitro}$ (°C.) | Hc (kOe) |
| 700 | 500 | 0.9 |
| 750 | 500 | 1.8 |
| 800 | 500 | 2.8 |
| 850 | 500 | 2.9 |
| 900 | 500 | 2.3 |
| 700 | 550 | 0.9 |
| 750 | 550 | 3.1 |
| 800 | 550 | 4.5 |
| 850 | 550 | 3.5 |
| 900 | 550 | 3.2 |
| 700 | 600 | 1.2 |
| 750 | 600 | 2.9 |
| 800 | 600 | 4.2 |
| 850 | 600 | 4.3 |
| 900 | 600 | 4.7 |
| 700 | 650 | 0.6 |
| 750 | 650 | 0.7 |
| 800 | 650 | 1.2 |
| 850 | 650 | 1.8 |
| 900 | 650 | 1.6 |

TABLE 12

| Dependence of coercivity on crystallization temperature Tcry and Nitrogenated temperature Tnitro for $Nd_{10}Fe_{75}Mo_{15}Nx$ samples and | | |
|---|---|---|
| $T_{cry}$ (°C.) | $T_{nitro}$ (°C.) | $H_c$ (kOe) |
| 700 | 600 | 3.8 |
| 750 | 600 | 4.8 |
| 800 | 600 | 7.5 |
| 850 | 600 | 8.0 |
| 700 | 630 | 5.0 |
| 750 | 630 | 4.3 |
| 800 | 630 | 7.2 |
| 850 | 630 | 8.0 |
| 850 | 570 | 7.6 |
| 850 | 660 | 7.0 |
| 850 | 680 | 6.0 |
| 850 | 700 | 5.5 |

Figure 2:
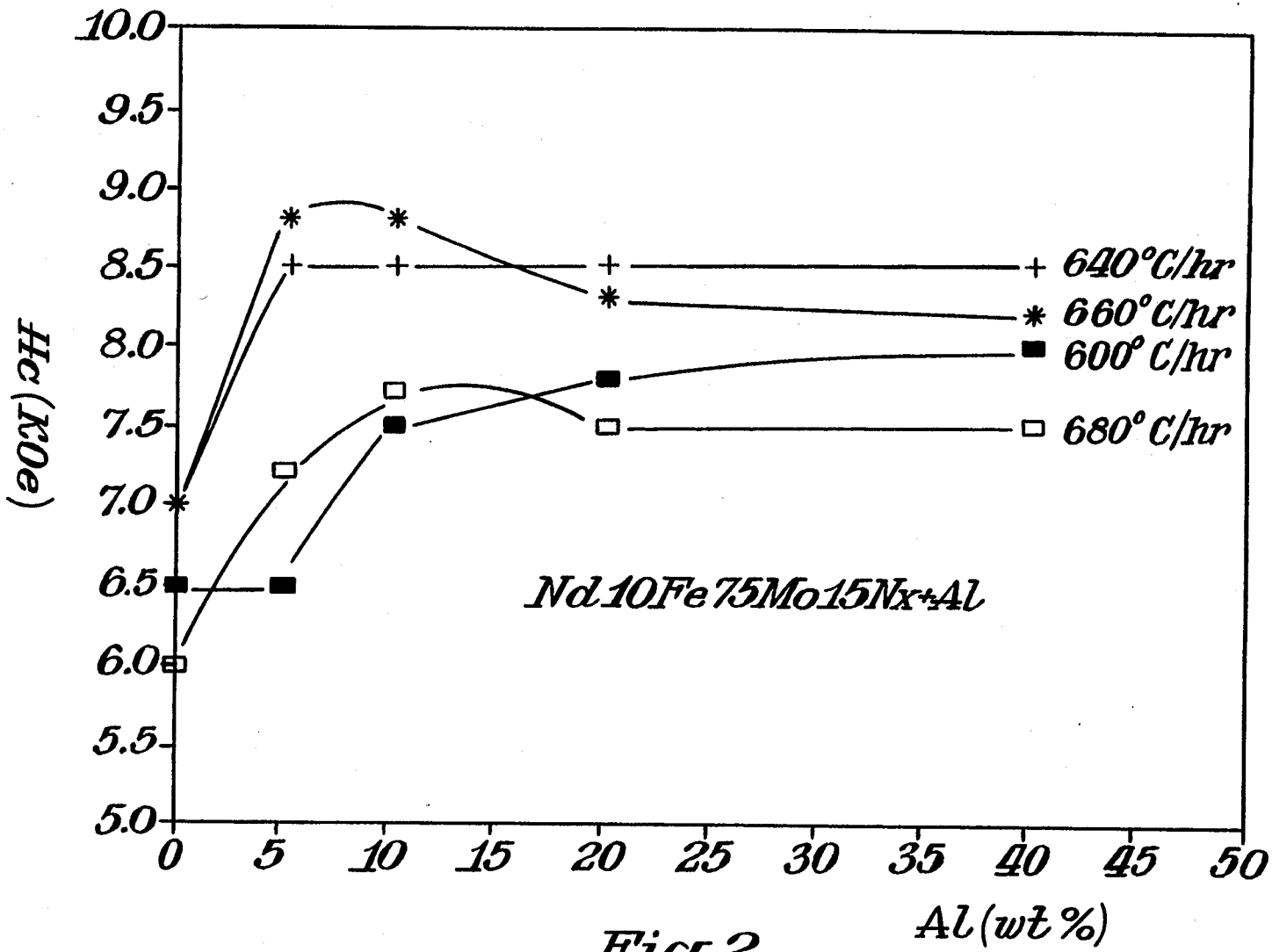
FIG. 2 shows the coercivity of magnets as a function of Al content (0–40%) at different bonding temperatures.

Al-bonded magnets were made with the $Nd_{10}Fe_{75}Mo_{15}N_{10}$ powders which gave us the best results after nitrogenation. Three hysteresis loops of $Nd_{10}Fe_{75}Mo_{15}$, $Nd_{10}Fe_{75}Mo_{15}N_x$ and $Nd_{10}Fe_{75}Mo_{15}N_x$+Al are shown in FIG. 1. The coercivity of the magnets as a function of the amounts of Al powders (0–40 wt. %) at different bonding temperatures. An average increase of the coercivity by about $\Delta H_c$=2.0 kOe was observed. The higher $H_c$ obtained in the bonded magnets was 8.8 kOe ($H_c$=9.5 kOe in a saturation field 55 kOe) when the bonding temperature was close to the melting temperature of Al at 660° C. for 1 hour. The coercivity increases initially with Al content in the range of 0–5 wt. % and at bonding temperatures 640°–660° C. Higher Al contents did not affect the coercivity but they hardened the samples. Al was found to surround the grains in the Al-bonded magnets as observed by microscopy and EDAX. Below the Al melting point, the Al powders do not influence the surface of the grains in the mechanically alloyed powders. However, above the Al melting point, the $Nd_{10}Fe_{75}Mo_{15}N_x$ nitride is decomposed into two phases, 1:12 and α-Fe. Therefore, the coercivity of the magnets is low in both of the above cases (see FIG. 2).

A small amount of Dy was used to improve the hard magnetic properties. An increase in coercivity by 2–3 kOe was obtained in $Nd_{10}Fe_{82}Mo_8N_x$ after an addition of 1.5 at. % Dy in the $Nd_{8.5}Dy_{1.5}Fe_{82}Mo_8N_x$ compound. The $Nd_{8.5}Dy_{0.15}Fe_{82}Mo_8N_x$ nitride powders were bonded with Zn powders at temperatures 410°–440° C. The data show that the coercivity does not change in all the bonded magnets, made with a value around 6.6 kOe. One of reasons may be the absence of the Fe—Zn phase which was observed in $Sm_2Fe_{17}N_x$+Zn-bonded magnets. The magnetic properties of three typical samples are summarized in Table 13.

TABLE 13

| Magnetic properties of three typical Nd—Fe—Mo samples. | | | |
|---|---|---|---|
| Sample | $M_s$ (emu/g) | $H_c$ (kOe) | $T_c$ (°C.) |
| $Nd_{10}Fe_{82}Mo_8N_x$ | 108.5 | 4.0 | 355 |
| $Nd_{8.5}Dy_{1.5}Fe_{82}Mo_8N_x$ | 105.0 | 6.6 | 360 |
| $Nd_{8.5}Dy_{1.5}Fe_{82}Mo_8N_x$ + Zn (10 wt %) | 92.0 | 6.6 | 360 |

Listed below are only some of the examples of temperature dependence of magnetic properties in Al bonded $Nd_{10}Fe_{78}Mo_{12}Nx$ and $Nd_{10}Fe_{15}Mo_{15}Nx$ below room temperature (see Tables 14–15).

TABLE 14

| Temperature Dependence of Coercivity Below Room Temperature in Al Bonded $Nd_{10}Fe_{78}Mo_{12}$ (with SQUID): | | | | |
|---|---|---|---|---|
| T (K) | $M_{55kOe}$ (emu/g) | Ms (emu/g) | Mr (emu/g) | Hc (kOe) |
| 10 | 77.2 | 83.0 | 45.8 | 22 |
| 77 | 81.2 | 87.8 | 51.7 | 20 |
| 150 | 86.2 | 93.5 | 54.4 | 15 |
| 220 | 89.5 | 96.0 | 52.0 | 11 |
| 273 | 91.0 | 99.0 | 47.8 | 7 |

TABLE 15

| Coercivity of Al Bonded Samples at Low Temperatures for $Nd_{10}Fe_{75}Mo_{15}$ nitrogenated magnet (measured with SQUID): | | | | |
|---|---|---|---|---|
| T (K) | $M_{55kOe}$ (emu/g) | Ms (emu/g) | Mr (emu/g) | Hc (kOe) |
| 10 | 51.9 | 60.0 | 24.9 | 23 |
| 77 | 58.9 | 63.0 | 35.2 | 22 |
| 273 | 66.0 | 72.5 | 35.0 | 9.5 |

Interstitial carbon atoms were found to increase the lattice constants of $Nd_{10}Fe_{75}Mo_{15}$ compounds. The hard magnetic properties $Nd_{10}Fe_{75}Mo_{15}C_x$ carbides with 1:12 phase are enhanced upon carbonation with $M_x$=78.7 emu/g and $T_c$=310° C., same as in $Nd_{10}Fe_{75}Mo_{15}N_x$ nitrides. However the coercivity of the 1:12 carbides was lower than the 1:12 nitrides. The coercivity of both the $Nd_{10}Fe_{75}Mo_{15}N_x$ and $Nd_{10}Fe_{75}Mo_{15}C_x$ samples as a function of nitrogenation and carbonation treatment temperature the high $H_c$ of 1:12 carbides was 4.0 kOe after carbonation at 650° C. for 2 hours. It is clear that hard magnetic properties of 1:12 carbides are inferior to those of the 1:12 nitrides.

The coercivity of mechanically alloyed powders does not depend only on the magnetic structure induced by nitrogenation but also on the microstructure which strongly depends on the crystallization temperature. For best permanent magnetic properties of these samples a higher N content and grain size about 4000 Å were required.

The magnetic properties of $Nd_{10}Fe_{75}Mo_{15}N_x$ compound depend strongly on the N content. A maximum N content x−10 atomic % was obtained in the $Nd_{10}Fe_{75}Mo_{15}N_x$ sample with the best hard magnetic properties; $H_c$=8.0 kOe, $M_x$=84.5 emu/g, and $T_c$=310° C.

When the Mo content is reduced from 15 to 8 atomic % in $Nd_{10}Fe_{90-y}Mo_yN_x$, the $Nd_{10}Fe_{82}Mo_8N_x$ the 1:12 single phase is maintained but with a lower $H_c$=4.0–4.5 kOe. An increase in coercivity by 2–3 kOe was obtained after the addition of 1.5 at. % Dy. No change in coercivity was observed in Zn-bonded magnets (Table 16).

Figure 3:
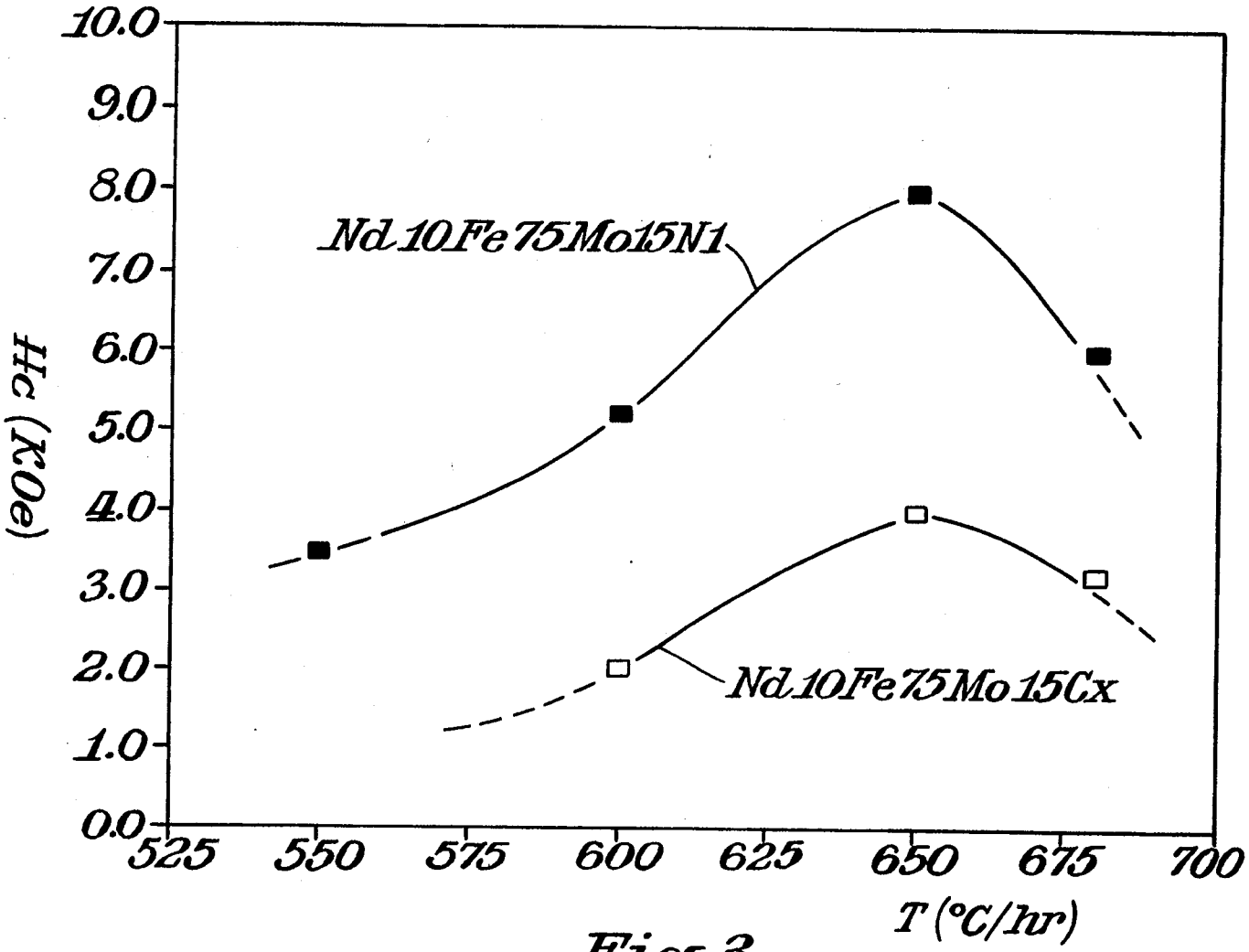
FIG. 3 shows the coercivity of $Nd_{10}Fe_{75}Mo_{15}N_x$ and $Nd_{10}Fe_{75}Mo_{15}C_x$ samples as a function of nitrogenation or carbonation for 2 hours and FIG. 4 shows the temperature dependence of $H_c$ for $Nd_{10}Fe_{75}Mo_{15}$, $Nd_{10}Fe_{75}Mo_{15}N_x$ and $Nd_{10}Fe_{75}Mo_{15}C_x$ compounds.

The $Nd_{10}Fe_{75}Mo_{15}C_x$ carbide has the same behavior as $Nd_{10}Fe_{75}Mo_{15}N_x$, but with a much lower coercivity, $H_c$=4.0 kOe. The experimental data are summarized in FIG. 3.

Figure 4:
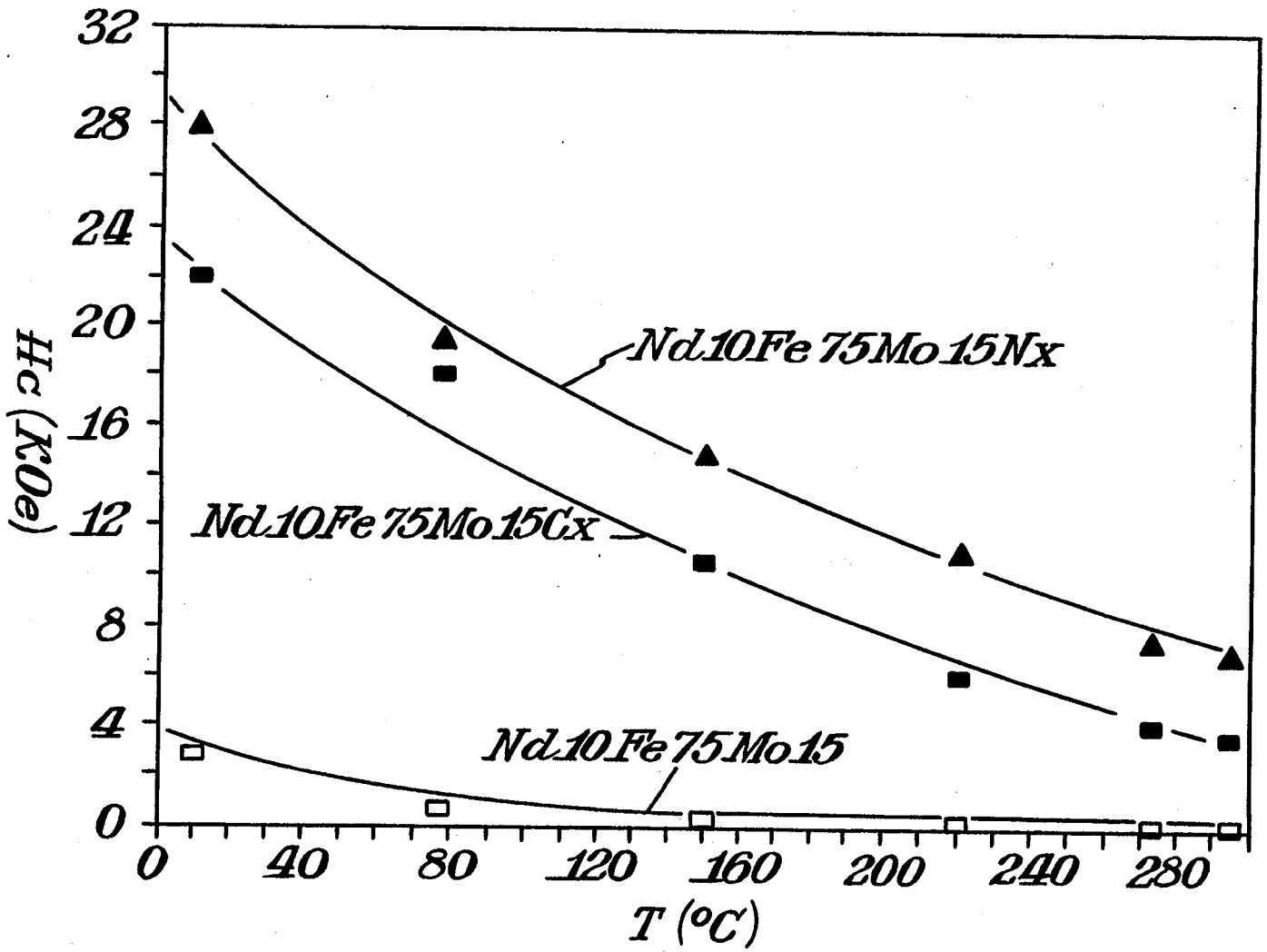

At low temperature, both the nitrides and carbides appear to have very high coercivities, $H_c$>22 kOe (FIG. 4).

As stated above, this invention can be practiced with carbides as well as nitrides. We have found a composition that will enable one to achieve high coercivities while being able to maintain high magnetic moments and Tc. Normally when one increases the magnetic moment it is at the expense of the coercivity. This also is true for increasing the coercivity at the expense of the moment.

TABLE 16

Coercivities of $Nd_{8.5}Dy_{1.5}Fe_{82}Mo_8N_x$ as a function of Zn content.

| Zn (wt %) | $T_{bond}$ (°C./hs) | $H_c$ (kOe) |
|---|---|---|
| 5 | 410 | 6.0 |
| 10 | 410 | 6.5 |
| 20 | 410 | 6.8 |
| 5 | 420 | 6.0 |
| 10 | 420 | 6.5 |
| 20 | 420 | 6.6 |
| 5 | 440 | 6.5 |
| 10 | 440 | 6.6 |
| 20 | 440 | 6.5 |

We claim:

1. A permanent magnet comprising $(R_xFe_{(y-w-)}Co_wM_z)_\beta L_\alpha$ wherein x+y+z equals 100 atomic %, w is present in an effective amount up to 20% in order to provide an increase in the Curie temperature, x is from 10 to about 20%, y is from about 65 to about 85%, and z is from 12 to about 20% and wherein R comprises Nd or Pr or a mixture thereof and M is selected from the group consisting of Cr, Mo, Ti, and V and mixtures thereof and L is nitrogen or carbon or a mixture thereof, $\alpha$ is about 4 to about 15% and $\beta$ is about 96 to about 85% and with the proviso that when M is V at 15.0 atomic % and R is Nd then Nd is present at 10%.

2. The magnet as claimed in claim 1, wherein x is from 10 to about 15% and y is from about 70 to about 80% and z is from 12 to about 20% and wherein w is present in an amount up to 10%.

3. The magnet as claimed in claim 1, wherein x is from 10 to about 15%, y is from about 75 to about 80% and z is from 12 to about 16% and M is selected from the group consisting of Cr, Mo, and V and mixtures thereof.

4. The magnet as claimed in claim 1, wherein R further comprises Dy, Tb, Y or La or mixtures thereof.

5. A permanent magnet comprising $(R_xFe_{(y-w-)}Co_wM_z)_{\beta L\alpha}$ wherein x+y+z equals 100 atomic %, w is present in an effective amount up to 20% in order to provide an increase in the Curie temperature, x is from about 5 to about 20%, y is from about 65 to about 85%, and z is from about 6% to about 20% and wherein R comprises Nd or Pr or a mixture thereof and M is selected from the group consisting of Cr, Mo, Ti, and V and mixtures thereof and L is nitrogen or carbon or a mixture thereof, $\alpha$ is about 4 to about 15% and $\beta$ is about 96 to about 85%.

6. The magnet as claimed in claim 5, wherein R is Nd.

7. The magnet as claimed in claim 5, wherein M is Mo.

8. The magnet as claimed in claim 5, wherein M is Cr.

9. The magnet as claimed in claim 5, wherein x is from about 8 to about 15% and y is from about 70 to about 80% and z is from about 10 to about 20% and w is present in an amount up to 10%.

10. The magnet as claimed in claim 9, wherein R is Nd.

11. The magnet as claimed in claim 10, wherein M is Mo.

12. The magnet as claimed in claim 5, wherein x is from about 10 to about 12%, y is from about 75 to about 80% and z is from about 10 to about 16%.

13. The magnet as claimed in claim 12, wherein R is Nd.

14. The magnet as claimed in claim 13, wherein M is Mo.

15. The magnet as claimed in claim 13, wherein M is Cr.

16. The magnet as claimed in claim 13, wherein M is Mo and R is Nd.

17. The magnet as claimed in claim 13, wherein M is Cr and R is Nd.

18. The magnet as claimed in claim 12, wherein M is Cr.

19. The magnet as claimed in claim 5, wherein R further comprises Dy, Tb, Y or La or mixtures thereof.

* * * * *